US008191610B2

(12) United States Patent
Mahapatra et al.

(10) Patent No.: US 8,191,610 B2
(45) Date of Patent: Jun. 5, 2012

(54) STRIP CASTING APPARATUS WITH IMPROVED SIDE DAM

(75) Inventors: Rama Ballav Mahapatra, Brighton-Le-Sands (AU); Brian E. Bowman, Waveland, IN (US)

(73) Assignee: Nucor Corporation, Charlotte, NC (US)

( * ) Notice: Subject to any disclaimer, the term of this patent is extended or adjusted under 35 U.S.C. 154(b) by 181 days.

(21) Appl. No.: 12/624,943

(22) Filed: Nov. 24, 2009

(65) Prior Publication Data

US 2010/0132912 A1 Jun. 3, 2010

Related U.S. Application Data

(60) Provisional application No. 61/117,435, filed on Nov. 24, 2008.

(51) Int. Cl.
*B22D 11/06* (2006.01)

(52) U.S. Cl. ..... 164/480; 164/428

(58) Field of Classification Search ..... 164/480, 164/428

See application file for complete search history.

(56) References Cited

U.S. PATENT DOCUMENTS

| | | | | |
|---|---|---|---|---|
| 4,811,780 | A | 3/1989 | Yamauchi et al. | |
| 5,035,278 | A | 7/1991 | Hasegawa et al. | |
| 5,040,591 | A | 8/1991 | Riboud et al. | |
| 5,058,657 | A | 10/1991 | Hasegawa et al. | |
| 5,172,750 | A * | 12/1992 | Birat et al. | 164/428 |
| 6,082,437 | A | 7/2000 | Damasse et al. | |
| 7,258,157 | B2 * | 8/2007 | Damasse et al. | 164/428 |

FOREIGN PATENT DOCUMENTS

| | | |
|---|---|---|
| AU | 618836 | 3/1990 |
| AU | 695332 | 8/1998 |
| JP | 2046949 | 2/1990 |

* cited by examiner

*Primary Examiner* — Kevin P Kerns

(74) *Attorney, Agent, or Firm* — Hahn, Loeser & Parks LLP; Arland T. Stein

(57) ABSTRACT

Apparatus for continuously casting metal strip includes a pair of counter-rotatable casting rolls laterally positioned to form a nip there between through which thin strip can be cast, a pair of confining side dams adjacent the ends of the casting rolls capable of confining a casting pool of molten metal supported on the casting rolls above the nip, each side dam having a surface capable of contacting the molten metal of the casting pool, with unraised portions and raised portions to form troughs with the unraised portions as base between the raised portion of the side dam and the casting surfaces of the casting rolls to guide the flow of molten metal, and a metal delivery system disposed above the nip and capable of discharging molten metal to form the casting pool supported on the casting rolls.

20 Claims, 11 Drawing Sheets

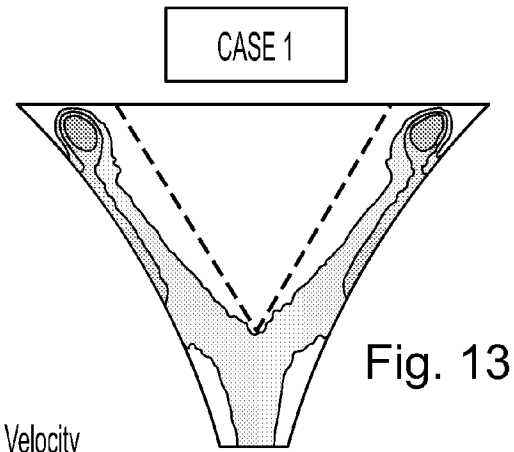
Fig. 13
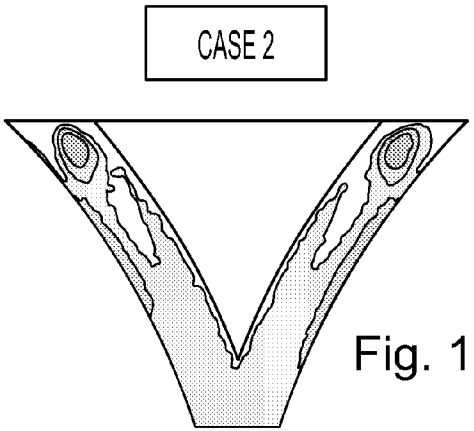
Fig. 14
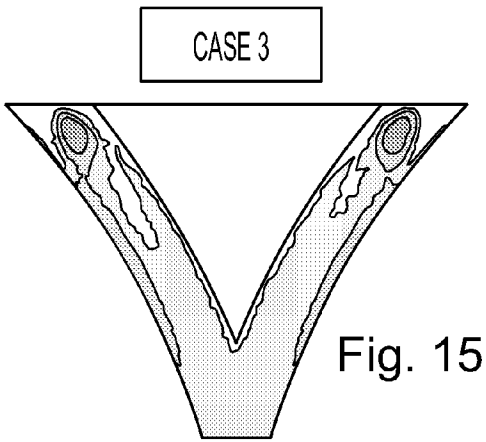
Fig. 15
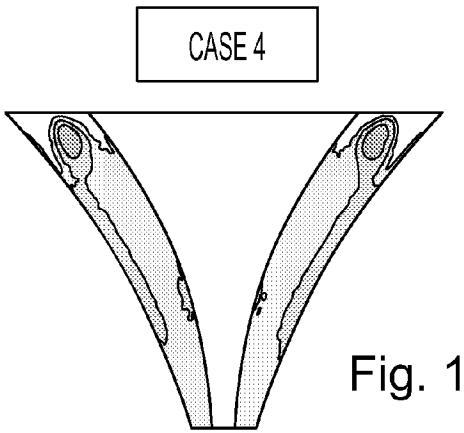
Fig. 16
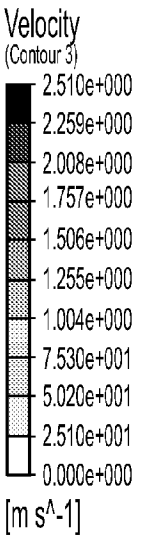

STRIP CASTING APPARATUS WITH IMPROVED SIDE DAM

CROSS-REFERENCE TO RELATED APPLICATIONS

This application claims the benefit of U.S. Provisional Application No. 61/117,435 filed Nov. 24, 2008, the disclosure of which is incorporated herein by reference.

BACKGROUND AND SUMMARY

This invention relates in general to continuous casting of thin metal strip by a twin roll caster.

In a twin roll caster molten metal is introduced between a pair of counter-rotated horizontal casting rolls that are cooled so that metal shells solidify on the moving roll surfaces, and are brought together at a nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle or series of delivery nozzles (also called the "core nozzles") located above the nip, forming a casting pool of molten metal supported on the casting surfaces of the rolls immediately above the nip and extending along the length of the nip. This casting pool is usually confined between side plates or dams held in sliding engagement with end surfaces of the casting rolls so as to dam the two ends of the casting pool against outflow.

Further, the twin roll caster may be capable of continuously producing cast strip from molten steel through a sequence of ladles. Pouring the molten metal from the ladle into a smaller vessel before flowing through the metal delivery nozzle enables the exchange of an empty ladle with a full ladle without disrupting the production of cast strip.

During operation, the metal flow rate and molten metal temperature in the area where the side dams, casting rolls and meniscus of the casting pool intersect, i.e. the "triple point" area or region, is controlled. Notably, the distance between the side dams and the ends of the delivery nozzles nearest the side dams should be controlled and maintained to prevent the formation of unwanted steels skulls either on the side dam or delivery nozzle.

Apparatus and method for controlling and maintaining a set distance between the outer ends of the delivery nozzles and the side dams during a campaign is disclosed in U.S. Pat. Nos. 6,910,523, 6,588,492, 7,147,035. The apparatus and method disclosed has a carriage assembly for commonly supporting the side dams and nearest delivery nozzles to maintain distance between the side dams and ends of the delivery nozzles at a set distance with wear of the side dams. The delivery nozzles could be moved relative to the side dams by the carriage assembly. The movement also involved simultaneously moving of both delivery nozzle and the adjacent side dam to maintain the distance between the side dam and end of the delivery nozzle. This movement affects the side dam force and thus side dam wear. Further, the movement of the side dam by the support to compensate for wear of the side dam required repositioning of the delivery nozzle to maintain the distance between the side dam and the end of the nearest delivery nozzle.

Solidified skulls may form from time to time on the side dam and also the delivery nozzle when the distance between the side dam and nozzle is not maintained. Additionally, skull formation is affected by flow patterns within the casting pool and temperature variations in the casting rolls and side dams. When these skulls drop into the roll nip, they cause the two solidifying shells at the casting roll nip to separate and "swallow" additional liquid steel between the shells causing the strip surface to reheat and causing the strip to break thus disrupting the continuous production of coiled strip. The dropped skulls at the nip are known as "snake eggs" and are detected as horizontal force spikes at the roll nip as well as visible bright bands across the width of the strip. Snake eggs also apply resistive forces against the side dam in addition to the forces generated by the ferrostatic head in the cast pool and can thus cause the side dam to lift from the casting roll edge resulting in the leakage of steel between the side dam and the casting roll necessitating termination of the casting sequence. Additionally, snake eggs passing through the nip between the casting rolls can cause lateral movement of the casting rolls and also cause movement in the side dams. To resist the increased forces generated by the snake eggs and the stiction of the side dam apply cylinders, the side dams are typically applied to the casting rolls with higher forces, thus increasing side dam wear.

We have found that improved flow within the molten pool and a reduction of skulls can be achieved by utilizing side dams with an improved shape during a casting campaign. The improved side dams have been found to allow for improved flow patterns within the casting pool and improved temperature control of the side dams. Improved flow patterns and temperature control, especially in the triple point pouring region, has led to a reduction in the occurrence of skulls and the incidence of snake eggs.

Disclosed is an apparatus for continuously casting metal strip which includes a pair of counter-rotatable casting rolls laterally positioned to form a nip there between through which thin strip can be cast, a pair of confining side dams adjacent the ends of the casting rolls capable of confining a casting pool of molten metal supported on the casting rolls and formed on the casting surfaces above the nip, each side dam has a surface capable of contacting the molten metal of the casting pool, the surface including an unraised portion and a raised portion with the unraised portion forming a base between the raised portion of the side dam and the casting surfaces of the casting rolls to guide the flow of molten metal, a metal delivery system disposed above the nip and capable of discharging molten metal to form the casting pool supported on the casting rolls.

The raised portion may form a trough of substantially constant width with the unraised portion as base between the raised portion and the casting rolls or a trough of substantially varying width with the unraised portion as base between the raised portion and the casting rolls. In the case of a varying width trough, the trough width may be greater toward the meniscus and less toward the nip. The trough width may vary by at least about 5 mm or by at least no more than about 25 mm. In any case, the width of the trough may be between about 5 mm and about 25 mm. The raised portion may extend in height from the unraised portion forming a trough at least about 3 mm or about 15 mm or less in depth. The troughs may extend in length from the tops of the side dams and may extend to the nip.

Also disclosed is a method of continuously casting metal strip which includes the steps of assembling a pair of counter-rotatable casting rolls to form a nip there between through which thin strip can be cast, assembling a pair of confining side dams adjacent the ends of the casting rolls capable of confining a casting pool of molten metal supported on the casting rolls and formed on the casting surfaces above the nip, each side dam has a surface capable of contacting the molten metal of the casting pool, the surface including an unraised portion and a raised portion with the unraised portion forming a base between the raised portion of the side dam and the casting surfaces of the casting rolls to guide the flow of molten metal, assembling a metal delivery system disposed above the nip and capable of discharging molten metal to form the casting pool supported on the casting rolls and counter rotating the casting rolls so as to cause the formed troughs to guide the flow of molten metal adjacent the casting surfaces of the casting rolls to form solidified shells of the casting surfaces and form cast strip discharging downwardly from the nip.

The raised portion may form a trough of substantially constant width with the unraised portion as base between the raised portion and the casting rolls or a trough of substantially varying width with the unraised portion as base between the raised portion and the casting rolls. In the case of a varying width trough the trough width may be greater toward the meniscus and less toward the nip. The trough width may vary by at least about 5 mm or by at least no more than about 25 mm. In any case, the width of the trough may be between about 5 mm and about 25 mm. The raised portion may extend in height from the unraised portion forming a trough at least about 3 mm or about 15 mm or less in depth. The troughs may extend in length from the tops of the side dams and may extend to the nip.

Various aspects of this invention will become apparent from the following detailed description and accompanying drawings.

BRIEF DESCRIPTION OF THE DRAWINGS

FIG. 13 is a graph illustrating the fluid flow velocities of a conventional side dam.

FIG. 14 is a graph illustrating the fluid flow velocities of the side dam of FIG. 10.

FIG. 15 is a graph illustrating the fluid flow velocities of the side dam of FIG. 11.

FIG. 16 is a graph illustrating the fluid flow velocities of the side dam of FIG. 12.

DETAILED DESCRIPTION OF THE PREFERRED EMBODIMENT

Figure 1:
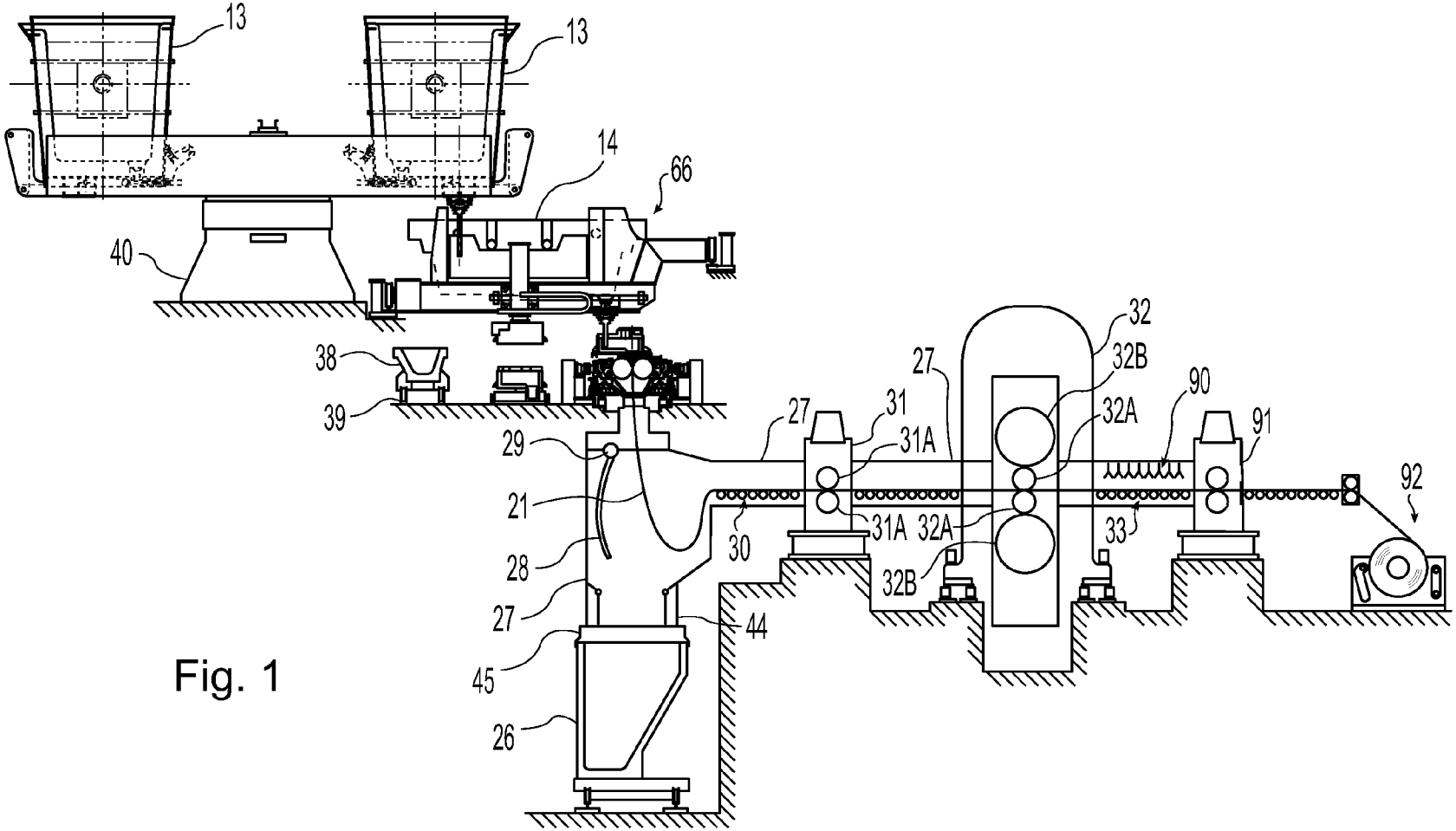
FIG. 1 is a diagrammatical side view of a portion of twin roll caster of the present disclosure.
Figure 2:
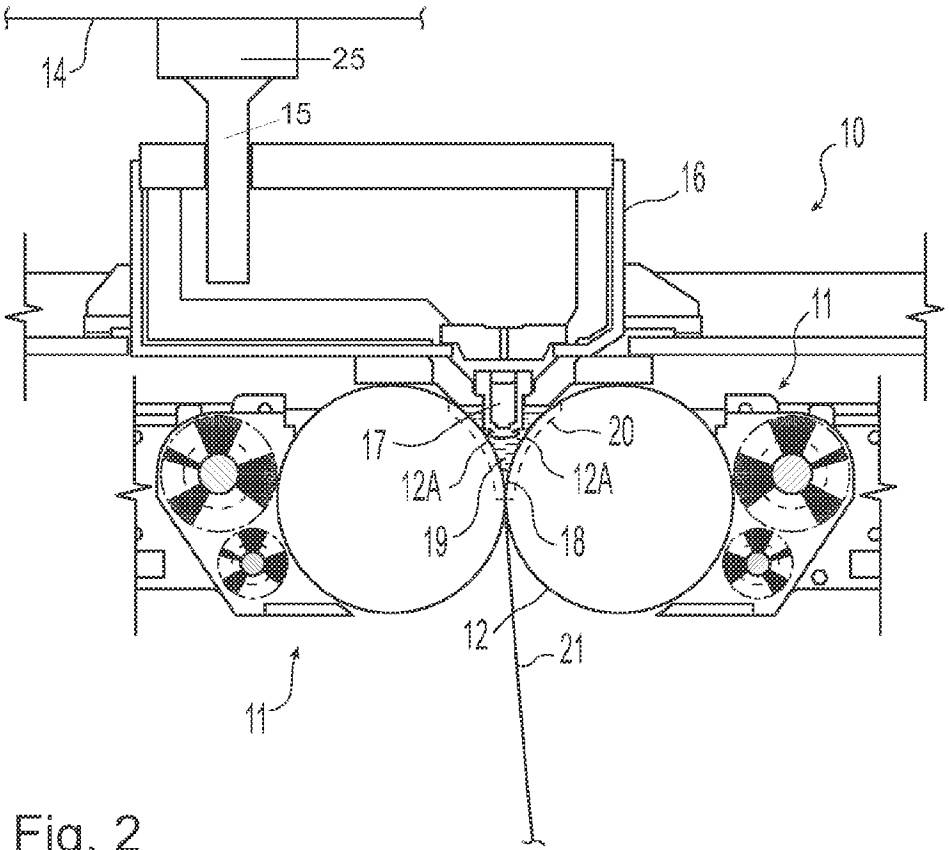
FIG. 2 is a partial sectional view through the casting rolls mounted in a roll cassette in the casting position of the caster of FIG. 1.

Referring now to the drawings, there is illustrated in FIGS. 1 and 2 a portion of a twin roll caster for continuously casting thin steel strip that comprises a main machine frame 10 that stands up from the factory floor and supports a roll cassette module 11 including a pair of counter-rotatable casting rolls 12 mounted therein. The casting rolls 12 having casting surfaces 12A laterally positioned to form a nip 18 there between. The casting rolls 12 are mounted in the roll cassette 11 for ease of operation and movement. The roll cassette facilitates rapid movement of the casting rolls ready for casting from a setup position into an operative casting position in the caster as a unit, and ready removal of the casting rolls from the casting position when the casting rolls are to be replaced. There is no particular configuration of the roll cassette that is desired, so long as it performs that function of facilitating movement and positioning of the casting rolls.

Molten metal is supplied from a ladle 13 through a metal delivery system, such as a movable tundish 14 and a transition piece or distributor 16. From the distributor 16, the molten metal flows to at least one metal delivery nozzle 17, or core nozzle, positioned between the casting rolls 12 above the nip 18. Molten metal discharged from the delivery nozzle 17 thus delivered forms a casting pool 19 of molten metal above the nip 18 supported on the casting surfaces 12A of the casting rolls 12. This casting pool 19 is confined in the casting area at the ends of the casting rolls 12 by a pair of side closures or confining plate side dams 20 (shown in dotted line in FIG. 2). The upper surface of the casting pool 19 (generally referred to as the "meniscus" level) may rise above the bottom portion of the delivery nozzle 17 so that the lower part of the delivery nozzle 17 is immersed in the casting pool 19. The casting area includes the addition of a protective atmosphere above the casting pool 19 to inhibit oxidation of the molten metal in the casting area.

The ladle 13 typically is of a conventional construction supported on a rotating turret 40. For metal delivery, the ladle 13 is positioned over a movable tundish 14 in the casting position to fill the tundish with molten metal. The movable tundish 14 may be positioned on a tundish car 66 capable of transferring the tundish from a heating station (not shown), where the tundish is heated to near a casting temperature, to the casting position. A tundish guide, such as rails, may be positioned beneath the tundish car 66 to enable moving the movable tundish 14 from the heating station to the casting position.

The movable tundish 14 may be fitted with a slide gate 25, actuable by a servo mechanism, to allow molten metal to flow from the tundish 14 through the slide gate 25, and then through a refractory outlet shroud 15 to a transition piece or distributor 16 in the casting position. From the distributor 16, the molten metal flows to the delivery nozzle 17 positioned between the casting rolls 12 above the nip 18.

The casting rolls 12 are internally water cooled so that as the casting rolls 12 are counter-rotated, shells solidify on the casting surfaces 12A as the casting surfaces 12A move into contact with and through the casting pool 19 with each revolution of the casting rolls 12. The shells are brought together at the nip 18 between the casting rolls 12 to produce a solidified thin cast strip product 21 delivered downwardly from the nip 18. The gap between the casting rolls is such as to maintain separation between the solidified shells at the nip so that semi-solid metal is present in the space between the shells through the nip, and is, at least in part, subsequently solidified between the solidified shells within the cast strip below the nip.

FIG. 1 shows the twin roll caster producing the thin cast strip 21, which passes across a guide table 30 to a pinch roll stand 31, comprising pinch rolls 31A. Upon exiting the pinch roll stand 31, the thin cast strip may pass through a hot rolling mill 32, comprising a pair of work rolls 32A, and backup rolls 32B, forming a gap capable of hot rolling the cast strip delivered from the casting rolls, where the cast strip is hot rolled to reduce the strip to a desired thickness, improve the strip surface, and improve the strip flatness. The work rolls 32A have work surfaces relating to the desired strip profile across the work rolls. The hot rolled cast strip then passes onto a run-out table 33, where it may be cooled by contact with a coolant, such as water, supplied via water jets 90 or other suitable means, and by convection and radiation. In any event, the hot rolled cast strip may then pass through a second pinch roll stand 91 to provide tension of the cast strip, and then to a coiler 92. The cast strip may be between about 0.3 and 2.0 millimeters in thickness before hot rolling.

At the start of the casting campaign, a short length of imperfect strip is typically produced as casting conditions stabilize. After continuous casting is established, the casting rolls are moved apart slightly and then brought together again to cause this leading end of the cast strip to break away forming a clean head end of the following cast strip. The imperfect material drops into a scrap receptacle 26, which is movable on a scrap receptacle guide. The scrap receptacle 26 is located in a scrap receiving position beneath the caster and forms part of a sealed enclosure 27 as described below. The enclosure 27 is typically water cooled. At this time, a water-cooled apron 28 that normally hangs downwardly from a pivot 29 to one side in the enclosure 27 is swung into position to guide the clean end of the cast strip 21 onto the guide table 30 that feeds it to the pinch roll stand 31. The apron 28 is then retracted back to its hanging position to allow the cast strip 21 to hang in a loop beneath the casting rolls in enclosure 27 before it passes to the guide table 30 where it engages a succession of guide rollers.

An overflow container 38 may be provided beneath the movable tundish 14 to receive molten material that may spill from the tundish. As shown in FIG. 1, the overflow container 38 may be movable on rails 39 or another guide such that the overflow container 38 may be placed beneath the movable tundish 14 as desired in casting locations. Additionally, an overflow container (not shown) may be provided for the distributor 16 adjacent the distributor 16.

The sealed enclosure 27 is formed by a number of separate wall sections that fit together at various seal connections to form a continuous enclosure wall that permits control of the atmosphere within the enclosure. Additionally, the scrap receptacle 26 may be capable of attaching with the enclosure 27 so that the enclosure is capable of supporting a protective atmosphere immediately beneath the casting rolls 12 in the casting position. The enclosure 27 includes an opening in the lower portion of the enclosure, lower enclosure portion 44, providing an outlet for scrap to pass from the enclosure 27 into the scrap receptacle 26 in the scrap receiving position. The lower enclosure portion 44 may extend downwardly as a part of the enclosure 27, the opening being positioned above the scrap receptacle 26 in the scrap receiving position. As used in the specification and claims herein, "seal," "sealed," "sealing," and "sealingly" in reference to the scrap receptacle 26, enclosure 27, and related features may not be a complete seal so as to prevent leakage, but rather is usually less than a perfect seal as appropriate to allow control and support of the atmosphere within the enclosure as desired with some tolerable leakage.

A rim portion 45 may surround the opening of the lower enclosure portion 44 and may be movably positioned above the scrap receptacle, capable of sealingly engaging and/or attaching to the scrap receptacle 26 in the scrap receiving position. The rim portion 45 may be movable between a sealing position in which the rim portion engages the scrap receptacle, and a clearance position in which the rim portion 45 is disengaged from the scrap receptacle. Alternately, the caster or the scrap receptacle may include a lifting mechanism to raise the scrap receptacle into sealing engagement with the rim portion 45 of the enclosure, and then lower the scrap receptacle into the clearance position. When sealed, the enclosure 27 and scrap receptacle 26 are filled with a desired gas, such as nitrogen, to reduce the amount of oxygen in the enclosure and provide a protective atmosphere for the cast strip.

The enclosure 27 may include an upper collar portion 43 supporting a protective atmosphere immediately beneath the casting rolls in the casting position. When the casting rolls 12 are in the casting position, the upper collar portion 43 is moved to the extended position closing the space between a housing portion 53 adjacent the casting rolls 12, as shown in FIG. 2, and the enclosure 27. The upper collar portion 43 may be provided within or adjacent the enclosure 27 and adjacent the casting rolls, and may be moved by a plurality of actuators (not shown) such as servo-mechanisms, hydraulic mechanisms, pneumatic mechanisms, and rotating actuators.

Figure 4:
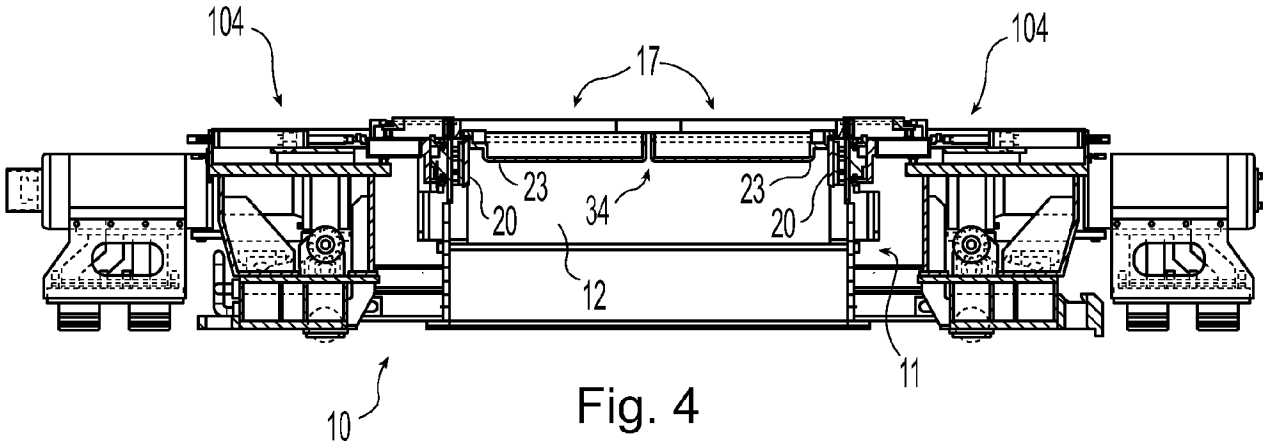
FIG. 4 is a transverse partial sectional view through the portion marked 4-4 in FIG. 3.

There is shown in FIG. 4 a pair of delivery nozzles 17 formed as substantially identical segments made of a refractory material such as zirconia graphite, alumina graphite or any other suitable material. It must be understood that more than two delivery nozzles 17 may be used in any different sizes and shapes if desired. The delivery nozzles 17 need not be substantially identical in size and shape, although generally such is desirable to facilitate fabrication and installation. Two delivery nozzles 17 may be provided, each capable of moving independently of the other above the casting rolls 12.

Typically where two delivery nozzles 17 are used the nozzles 17 are disposed and supported in end-to-end relationship along the nip 18 with a gap 34 therebetween, so that each delivery nozzle 17 can be moved inwardly toward each other during a casting campaign as explained below. It must be understood, however, that any suitable number of delivery nozzles 17 may be used, including two delivery nozzles 17 as described below and including any additional number of nozzles 17 disposed therebetween. For example, there may be a central nozzle segment adjacent to outer nozzle segments on either side.

Each delivery nozzle 17 may be formed in one piece or multiple pieces. As shown, each nozzle 17 includes an end wall 23 positioned nearest a confining side dam 20 as explained below. Each end wall 23 may be configured to achieve a particular desired molten metal flow in the triple point region between the casting rolls 12 and the respective side dam 20.

The side dams 20 may be made from a refractory material such as zirconia graphite, graphite alumina, boron nitride, boron nitride-zirconia, or other suitable composites. The side dams 20 have a surface capable of physical contact with the casting rolls and molten metal in the casting pool.

Figure 5:
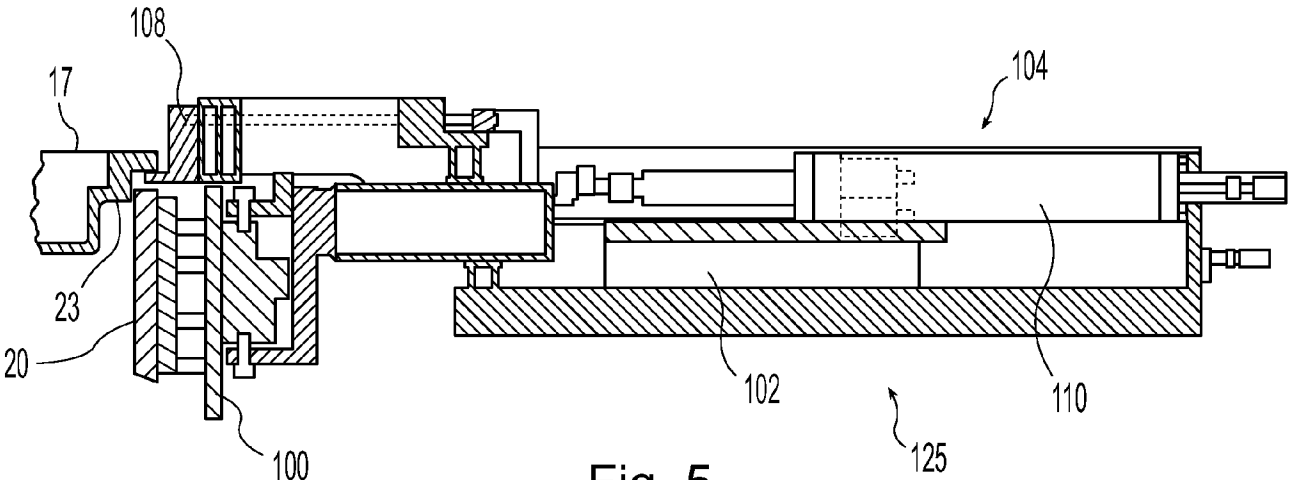
FIG. 5 is an enlarged view of one of the carriage assemblies marked as detail 5 in FIG. 4.
Figure 6:
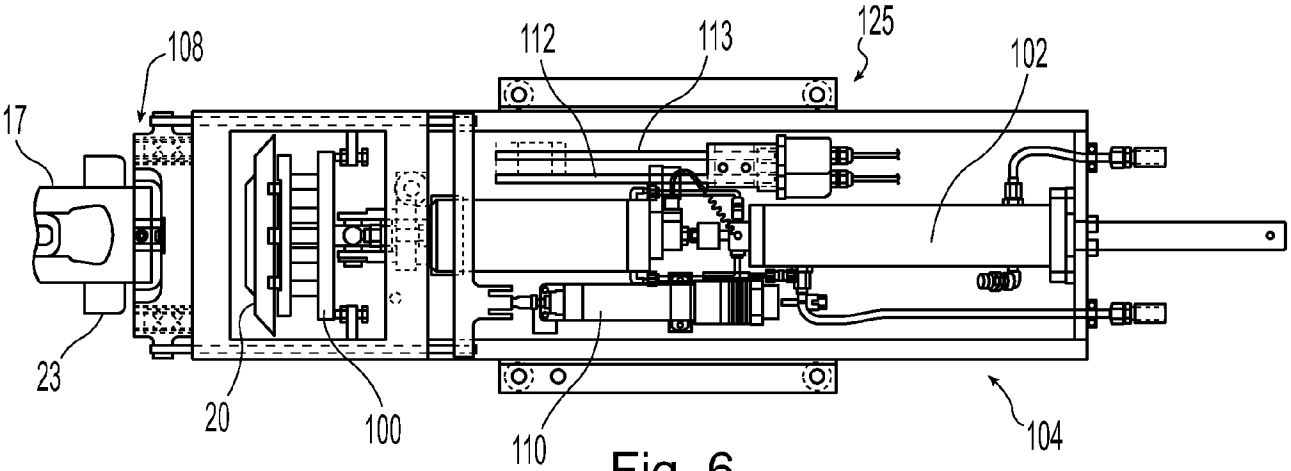
FIG. 6 is a plan view, partially in section, of the carriage assembly of FIG. 5 with the side dam in a first position.
Figure 7:
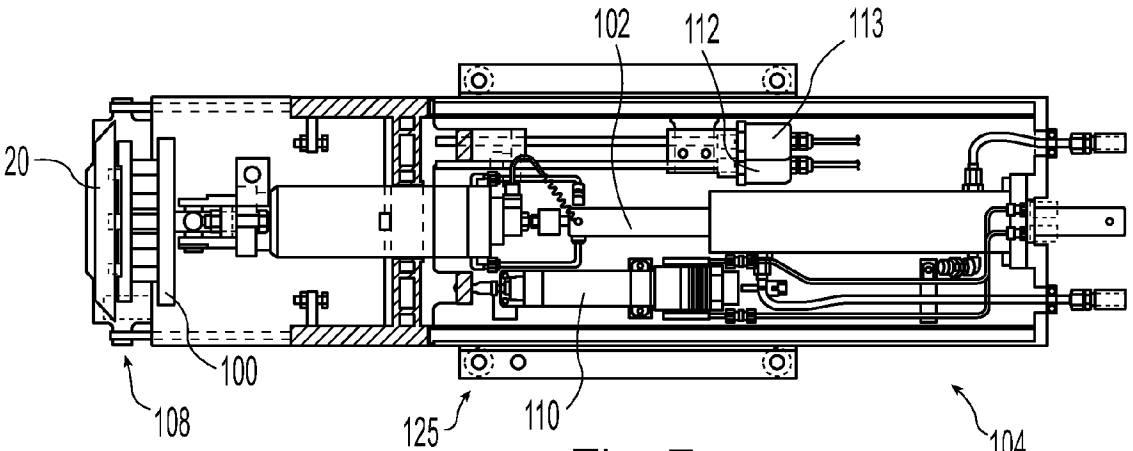
FIG. 7 is a view similar to FIG. 6 with the side dam in a second position.

A pair of carriage assemblies, generally indicated at 104, are provided to position the side dams 20 and the delivery nozzles 17. As illustrated, the twin roll caster is generally symmetrical, although such is not required. Referring to FIGS. 5-7, one carriage assembly 104 is illustrated and described below, with the other carriage assembly 104 being generally similar. It is understood that the twin roll caster may utilize any number of carriage assemblies 104 configured in any suitable manner to provide a flow of molten metal to the casting pool 19. Each carriage assembly 104 is disposed at one end of the pair of casting rolls 12. Each carriage assembly 104 may be mounted fixed relative to the machine frame 10, or may be moveable axially toward and away from the casting rolls 12 to enable the spacing between the carriage assembly 104 and the casting rolls 12 to be adjusted. The carriage assemblies 104 may be preset in final position before a casting campaign to suit the width of the casting rolls 12 for the strip to be cast, or the position of the carriage assembly 104 may be adjusted as desired during a casting campaign. The carriages 104 may be positioned one at each end of the roll assembly and moveable toward and away from one another to enable the spacing between them to be adjusted. The carriages can be preset before a casting operation according to the width of the casting rolls and to allow quick roll changes for differing strip widths. The carriages 104 may be positioned so as to extend horizontally above the casting rolls with the nozzles 17 positioned beneath the distributor 16 in the casting position and at a central position to receive the molten metal.

For example the carriage assembly 104 may be positioned from tracks (not shown) on the machine frame 10, which may be mounted by clamps or any other suitable mechanism. Alternatively, the carriage assembly 104 may be supported by its own support structure relative to the casting rolls 12.

The carriage assembly 104 includes a support frame 125. A nozzle bridge 108 is moveably connected to the support frame 125 and engages the delivery nozzles 17 for selective movement thereof. A nozzle actuator 110 is mounted to the support frame 125 and connected to the nozzle bridge 108 for moving the nozzle bridge 108 and thus moving the delivery nozzles 17 to position the end wall 23 relative to the side dam 20. The nozzle actuator 110 is thus capable of positioning the delivery nozzles 17. The nozzle actuator 110 is a conventional servo mechanism. It must be understood, however, that the nozzle actuator 110 may be any drive mechanism suitable to move and adjust delivery nozzles 17. For example, the nozzle actuator 110 may be a screw jack drive operated by an electric motor, a hydraulic mechanism, a pneumatic mechanism, a gear mechanism, a cog, a drive chain mechanism, a pulley and cable mechanism, a drive screw mechanism, a jack actuator, a rack and pinion mechanism, an electro-mechanical actuator, an electric motor, a linear actuator, a rotating actuator, or any other suitable device.

A nozzle position sensor 113 senses the position of the delivery nozzles 17. The nozzle position sensor 113 is a linear displacement sensor to measure the change in position of the nozzle bridge 108 relative to the support frame 125. The nozzle position sensor 113 may be any sensor suitable to indicate any parameter representative of a position of the delivery nozzles 17. For example, the nozzle position sensor 113 may be linear variable displacement transformer to respond to the extension of the nozzle actuator 110 to provide signals indicative of movement of the delivery nozzles 17, or an optical imaging device for tracking the position of the delivery nozzles 17 or any other suitable device for determining the location of the delivery nozzles 17.

The side dam 20 is mounted to a plate holder 100 which is moveably connected to the support frame 125 and engages the side dam 20 for selective movement thereof. A side dam actuator 102 is mounted to the support frame 125 and connected to the plate holder 100 for moving the plate holder 100 and thus moving each side dam 20 to position the side dam 20 relative to the casting rolls 12. The side dam actuator 102 is thus capable of positioning the side dam 20 and capable of cyclically varying the axial force of the side dams as described below. The side dam actuator 102 is a hydraulic force cylinder. It must be understood, however, that the side dam actuator 102 may be any suitable drive mechanism to position the plate holder 100 to bring the side dam 20 into engagement with the casting rolls 12 to confine the casting pool 19 formed on the casting surfaces 12A during a casting operation. Such a suitable drive mechanism, for example, may be a servo mechanisms, a screw jack drive operated by electric motor, a pneumatic mechanism, a gear mechanism, a cog, a drive chain mechanism, a pulley and cable mechanism, a drive screw mechanism, a jack actuator, a rack and pinion mechanism, an electro-mechanical actuator, an electric motor, a linear actuator, a rotating actuator, or any other suitable device. Thus, the side dams 20 are mounted in side dam plate holders 100, which are movable by side dam actuators 102, such as a servo mechanism, to bring the side dams 20 into engagement with the ends of the casting rolls. Additionally, the side dam actuators 102 are capable of positioning the side dams 20 during casting. The side dams 20 thus form end closures for the molten pool of metal on the casting rolls during the casting operation.

A side dam position sensor 112 senses the position of the side dam 20. The side dam position sensor 112 is a linear displacement sensor to measure the actual change in position of the plate holder 100 relative to the support frame 125. The side dam position sensor 112 may be any sensor suitable to indicate any parameter representative of a position of the side dam 20. For example, the side dam position sensor 112 may be a linear variable displacement transducer to respond to the extension of the side dam actuator 102 to provide signals indicative of position of the side dam 20, or an optical imaging device for tracking the position of the side dam 20 or any other suitable device for determining the location of the side dam 20. The side dam position sensor 112 may also or alternatively include a force sensor, or load cell for determining the force urging the side dam 20 against the casting rolls 12 and providing electrical signals indicative of the force urging the side dam against the casting rolls.

In any case the actuators 110 and 102 and the sensors 113 and 112 may be connected into a control system in the form of a circuit receiving control signals determined by measurement of the distance variation between the delivery nozzles 17 and the confining side dams 20, and between the side dams 20 and the casting rolls 12. For example, small water cooled video cameras may be installed on the nozzle bridge 108, or any other suitable structure, to directly observe the distance between the delivery nozzles 17 and the confining side dams 20 and the side dams 20 and the casting rolls 12, and to produce control signals to be fed to position encoders on the actuators 110 and 102. With any arrangement, precise control of the distance between the end walls 23 of the delivery nozzle 17 and the side dams 20 and the side dams 20 and the casting rolls 12 may be maintained. Moreover these distances can be accurately set and maintained by independent operation of the actuators 110 and 102 during casting. For example, the distance between the end wall 23 and the side dam 20 may be set so that a discharge of molten metal is positioned to a target area on the side dam 20 relative to the triple point regions.

During a casting campaign the control system of the twin roll caster is capable of actuating the side dam actuators 102 to vary the apply force on the side dams 20 against the ends of the casting rolls 12 in the axial direction, i.e. along the axis of the centerlines of the two casting rolls. The apply force is not varied such that the side dams 20 develop a clearance at edges of the casting rolls 12 that may cause leakage of molten metal from the casting pool. The control system may receive position or force information from the sensors 112 or from direct feedback of the actuator 102.

Figure 9:
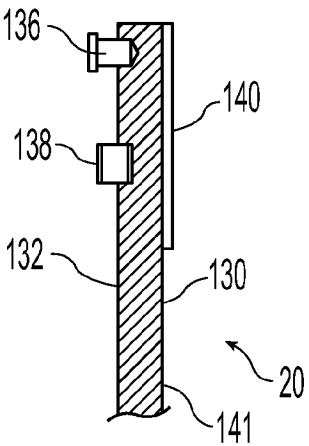
FIG. 9 is a cross sectional view of the side dam in FIG. 8 take along line 9-9.
Figure 8:
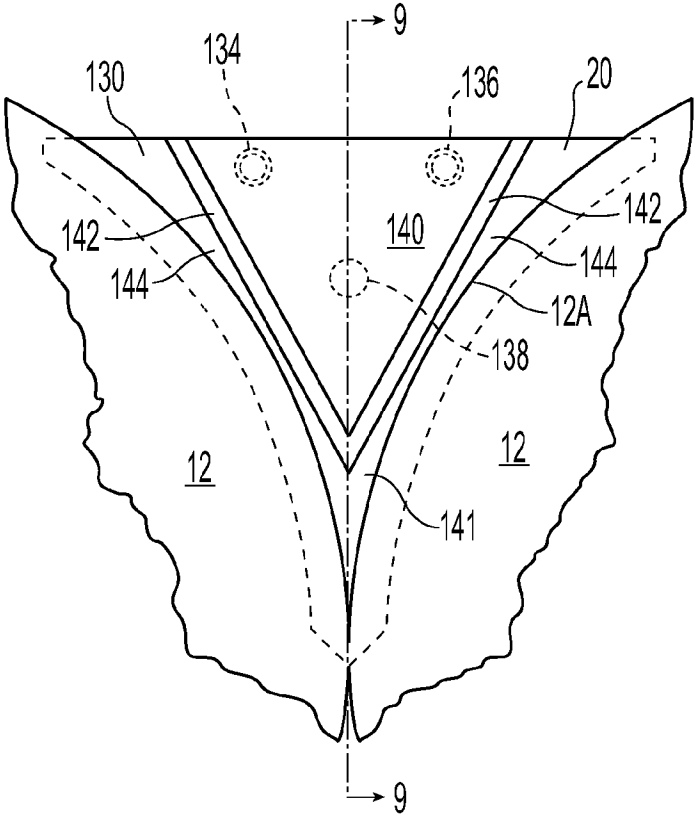
FIG. 8 is an enlarged view of a portion of FIG. 2.

As illustrated in FIGS. 8 and 9, the side dam 20 includes a front surface 130 and a rear surface 132. Three fastening portions 134, 136, and 138 extend from the rear surface 132. The fastening portions 134, 136, and 138 are refractory fasteners (e.g., ceramic pins) which are held in place within holes in the side dam 20 by a ceramic adhesive or glue. The refractory fasteners 134, 136, and 138 extend outward beyond the rear surface 132 of the side dam 20. The side dam 20 may be held in place by a side dam holder (not shown) cooperating with the fastening portions 134, 136, and 138.

The side dam 20 includes a raised portion 140 extending from an unraised portion 141 of the surface 130 of the side dam 20 that is capable of contacting molten metal of a casting pool during casting. The raised portion 140 includes side walls 142 that form a trough 144 with the unraised portion 141 as the base between the side walls 142 of raised portions 140 and casting surfaces of 12A of the casting rolls 12. As illustrated, the side walls 142 may form an obtuse angle with the unraised portion 141. It should be understood, however, that the side walls 142 and the unraised portion 141 may meet at right angles, acute angles, compound angles, or another suitable interface. The raised portion 140 may be generally triangular in shape, with curved or straight sides, extending generally laterally along the front surface 130. Alternatively, the raised portion 140 may have any shape to form the trough 144 by the unraised portion 141 and the casting rolls 12. Additionally, the raised portion may be relatively planar or have any other surface geometry, as desired to direct the flow of molten metal. For example, the raised portions alternatively may be arcuate in shape. In any case, the unraised and raised portions 140 and 141 are dimensioned to generally define the shape and size by the trough 144 in width and depth. The trough 144 may be between 5 and 25 millimeters in width and 3 to 15 millimeters in depth. The trough width is defined between the side walls 142 and the casting roll surfaces 12A. The trough depth is defined by the thickness of the raised portion 140 relative to the unraised portion 141 and the shape is defined by the geometry of the casting roll surfaces 12A and the side walls 142.

As shown in FIG. 8, the side walls 142 may be substantially linear. In any case, the trough 144 defined between the unraised and raised portions of the side dam and casting roll surfaces 12A may be wider toward upper portion of the side dam 20 contacting the meniscus of the casting pool and at the nip and narrower in between. As the curved casting roll surfaces 12A pass along the linear side walls 142 the width of the trough 144 narrows as the surfaces 12A and walls 142 come closer together, thus varying the width of the trough 144. It should be understood that the troughs 144 will be of varying width except in the case where the geometry of the side walls 142 matches the curved geometry of the casting roll surfaces 12A at a constant separation distance.

The side walls 142 may be arcuate in shape, either convex, as to accentuate the variation in separation distance between the side walls 144 and the casting roll surfaces 12A, or concave, as to minimize the variation in separation distance between the side walls 144 and the casting roll surfaces 12A. In the case as described above where the geometry of the side walls 142 matches the curved geometry of the casting roll surfaces 12A at a constant separation distance the trough 144 would thus be of uniform width along its length.

Figure 12:
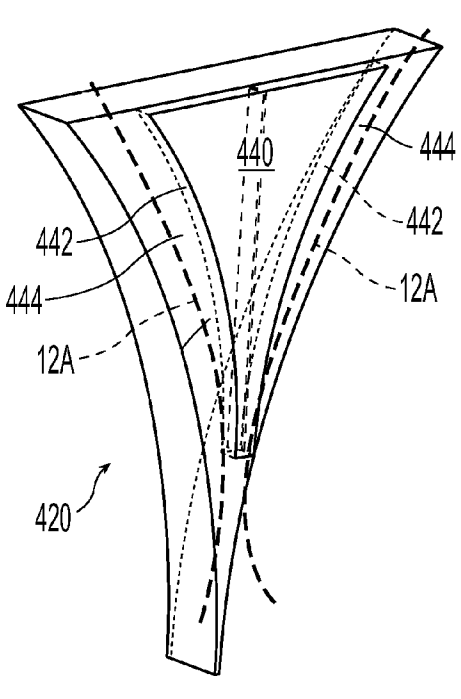
FIG. 12 a perspective view of a side dam similar to the side dam shown in FIG. 10, except having a raised portion defining a trough of variable width.
Figure 11:
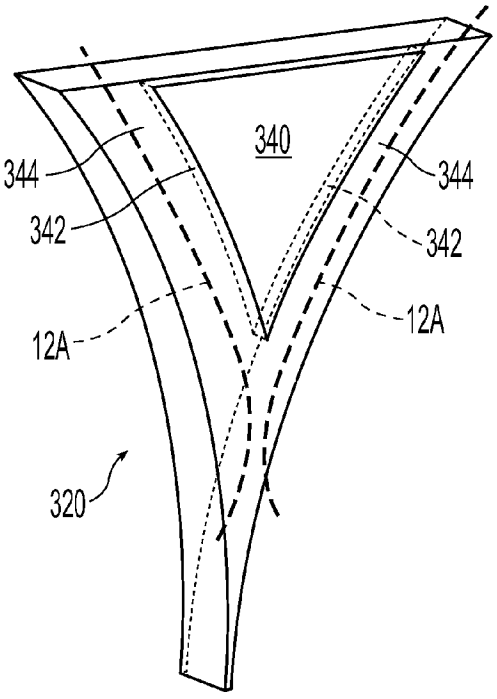
FIG. 11 is a perspective view of a side dam similar to the side dam shown in FIG. 10, except having a raised portion of a different thickness.
Figure 10:
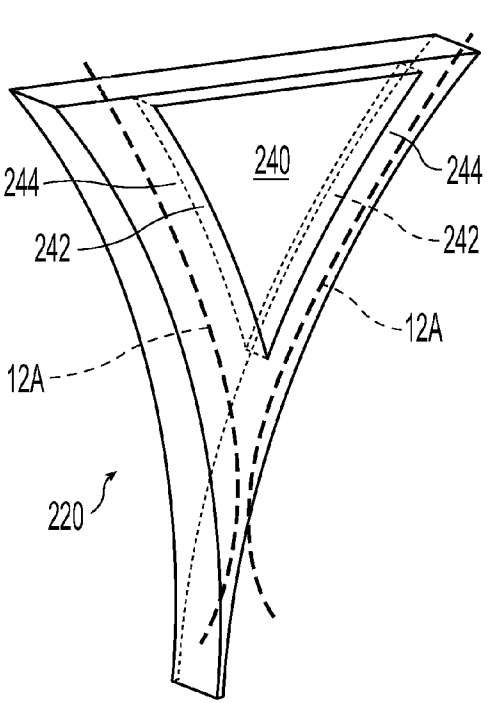
FIG. 10 is a perspective view of a side dam similar to the side dam shown in FIG. 8, except having a constant width trough.

There is shown in FIGS. 10-12, side dams 220, 320 and 420, respectively, with similar features identified with similar numerical identifiers as FIGS. 8 and 9. The side dams 220, 320 and 420 include raised portions 240, 340 and 440 with arcuate side walls 242, 342 and 442 forming troughs 244, 344 and 444. The side walls 242 and 342 have a curvature that substantially corresponds to the curvature of the casting roll surfaces 12A and thus maintain a substantially constant width trough 244 or 344, respectively. For example, the trough width may be 10 or 20 mm. As shown, in FIG. 10, the raised portion 240 extends, for example, 10 mm from the unraised portion 241 at the side wall 242. As shown, in FIG. 11, the raised portion 340 extends, for example, 6 mm beyond the unraised portion 341 at the side wall 342.

As illustrated in FIG. 12 the side walls 442 are shaped to narrow the trough 444 toward the nip. As shown, the raised portion 440 extends 6 mm above the unraised portion 441 at the side walls 442 and the trough 444 varies between 20 mm to 6 mm from the upper portion adjacent the meniscus of the casting pool to the nip.

There is shown in FIGS. 13-16 a series of graphs illustrating the fluid flow velocities of a variety of side dams. FIGS. 13-16 show sample analysis performed in ANSYS of the fluid flow characteristics of a conventional side dam, Case 1—FIG. 13 and the side dams in FIGS. 10-12, Cases 3, 2, and 4—FIGS. 15, 14, and 16, respectively. As seen in FIGS. 13-16, higher fluid flow velocities are achieved along the side dam-casting roll arc are by the side dams with a raised portion, 340, 240, 440, forming a trough, 344, 244, 444, as compared to the conventional side dam.

Figure 17:
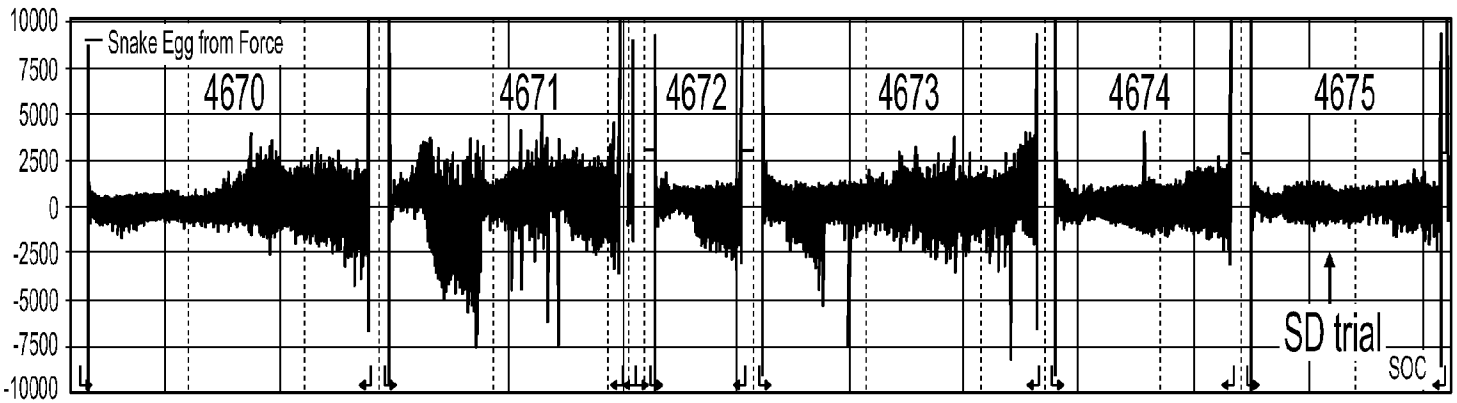
FIG. 17 is a graph illustrating the incidence of snake eggs during a series of casting campaigns.
Figure 18:
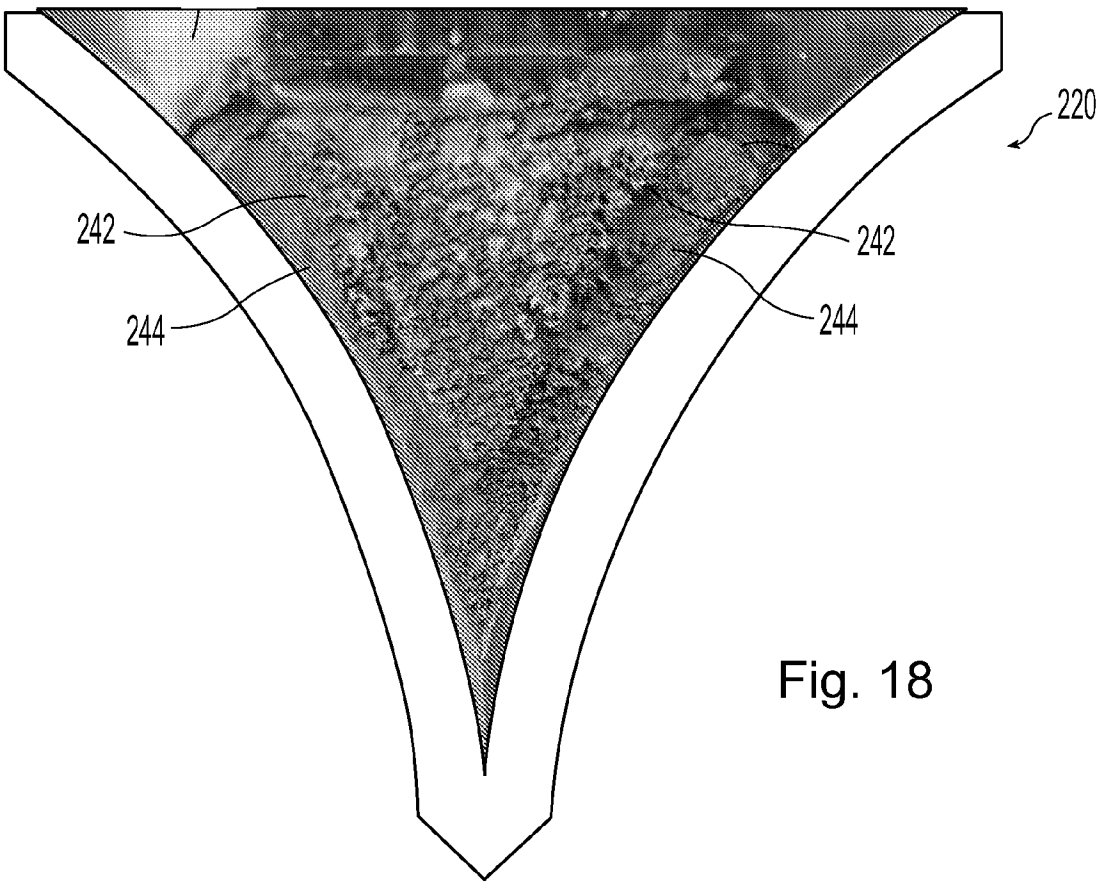
FIG. 18 is a front of one side dam similar to the side dam of FIG. 10 after a casting campaign.
Figure 19:
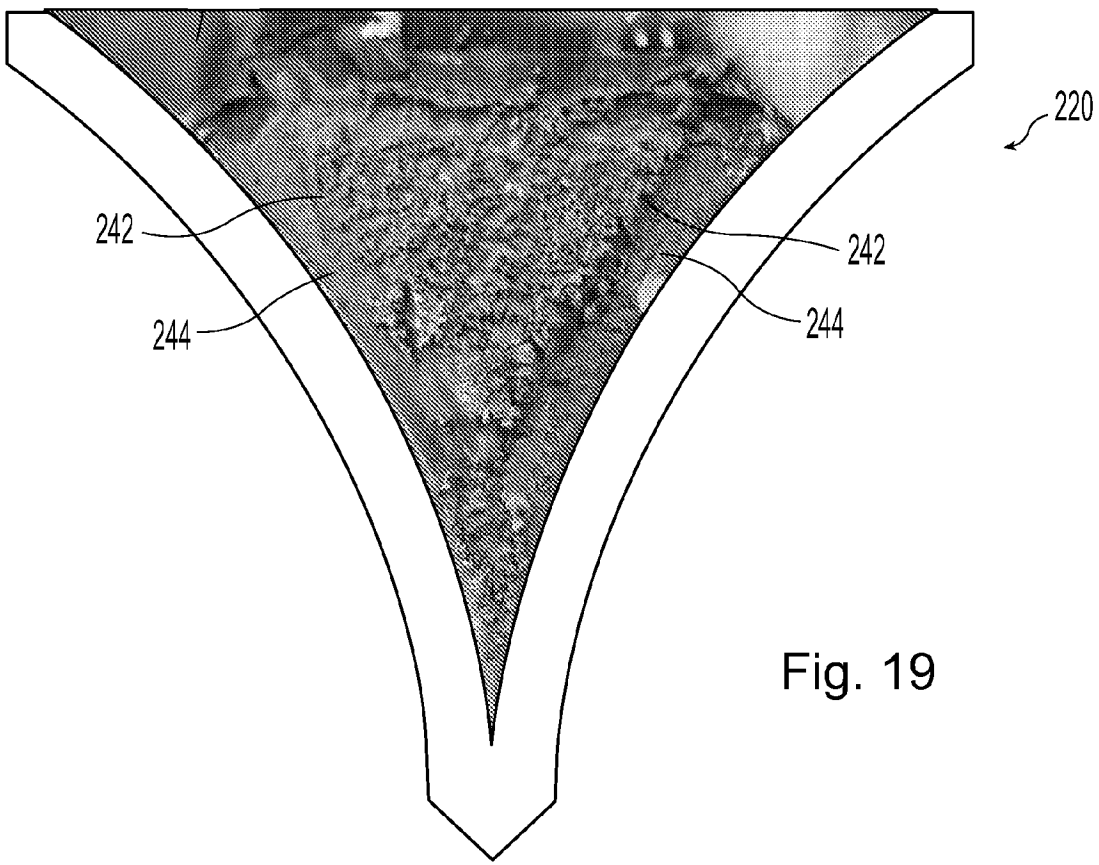
FIG. 19 is a front of another side dam similar to the side dam of FIG. 10 after a casting campaign.
Figure 3:
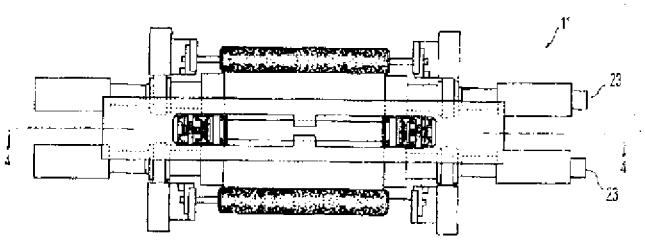

There is shown in FIG. 17 a graph illustrating a series of casting campaigns, 4670-4675, with campaign 4675 utilizing side dams 220 of FIG. 10. These side dams 220 are shown as used after the campaign in FIGS. 18 and 19. The graph in FIG. 17 shows the incidence of snake eggs as determined from force on the casting rolls. The magnitude of snake egg occurrence/force is clearly less with the use of the side dams 220. Additionally, there was no occurrence of spikes in lateral force caused by snake egg occurrence.

While the principle and mode of operation of this invention have been explained and illustrated with regard to particular embodiments, it must be understood, however, that this invention may be practiced otherwise than as specifically explained and illustrated without departing from its spirit or scope.

What is claimed is:

1. Apparatus for continuously casting metal strip comprising:

(a) a pair of counter-rotatable casting rolls laterally positioned to form a nip there between through which thin strip can be cast;

(b) a pair of confining side dams adjacent the ends of the casting rolls capable of confining a casting pool of molten metal supported on the casting rolls and formed on casting surfaces above the nip, (c) each side dam having a surface capable of contacting the molten metal of the casting pool during casting, with an unraised portion and a raised portion, with the raised portion configured to form a trough between the raised portion of the side dam and the casting surfaces of the casting rolls to guide the flow of molten metal adjacent the casting surfaces of the casting rolls, where the unraised portion of the side dam forms a base of the trough; and (d) a metal delivery system disposed above the nip and capable of discharging molten metal to form the casting pool supported on the casting rolls.

2. The apparatus for continuously casting metal strip of claim 1 where each trough is capable of extending at least about 5 mm between the unraised portion of the side dam and the casting surfaces of the casting rolls at a meniscus of the casting pool during casting.

3. The apparatus for continuously casting metal strip of claim 2 where each trough is equal to or less than about 25 mm there along.

4. The apparatus for continuously casting metal strip of claim 1 where each trough is of substantially uniform width between the raised portions of the side dams and the casting surfaces of the casting rolls.

5. The apparatus for continuously casting metal strip of claim 1 where the troughs are of varying width between the raised portions of the side dams and the casting rolls.

6. The apparatus for continuously casting metal strip of claim 5 where each trough width is capable of being wider toward the meniscus of the casting pool and less toward the nip.

7. The apparatus for continuously casting metal strip of claim 5 where each trough width is at least about 5 mm.

8. The apparatus for continuously casting metal strip of claim 5 where each trough width is no more than about 25 mm.

9. The apparatus for continuously casting metal strip of claim 1 where the raised portion of each side dam shaped to be capable of guiding flow of molten metal in a casting pool.

10. The apparatus for continuously casting metal strip of claim 1 where the raised portion is arcuate.

11. A method of continuously casting metal strip comprising steps:

(a) assembling a pair of counter-rotatable casting rolls to form a nip there between through which thin strip can be cast;

(b) assembling a pair of confining side dams adjacent the ends of the casting rolls capable of confining a casting pool of molten metal supported on casting surfaces of the casting rolls above the nip such that each side dam has a surface capable of contacting the molten metal of the casting pool during casting with an unraised portion and a raised portion, with the raised portion configured to form a trough between the raised portion of the side dam and the casting surfaces of the casting rolls, where the unraised portion of the side dam forms a base of the trough;

(c) assembling a metal delivery system disposed above the nip and capable of discharging molten metal to form the casting pool supported on casting surfaces of the casting rolls; and (d) counter rotating the casting rolls so as to cause the formed troughs to guide the flow of molten metal adjacent the casting surfaces of the casting rolls to form solidified shells of the casting surfaces and form cast strip discharging downwardly from the nip.

12. The method of continuously casting metal strip of claim 11 where each trough is formed to be capable of extending at least about 5 mm between the unraised portion of the side dam and the casting surfaces of the casting rolls at a meniscus of the casting pool during casting.

13. The method of continuously casting metal strip of claim 11 where each trough is formed to be equal to or less than about 25 mm there along.

14. The method of continuously casting metal strip of claim 11 where each trough is formed of substantially uniform width between the raised portions of the side dams and the casting surfaces of the casting rolls.

15. The method of continuously casting metal strip of claim 11 where each trough is formed of varying width between the raised portions and the casting rolls.

16. The method of continuously casting metal strip of claim 15 where each trough width is capable of being wider toward the meniscus of the casting pool and less toward the nip.

17. The method of continuously casting metal strip of claim 15 where each trough width is at least about 5 mm.

18. The method of continuously casting metal strip of claim 15 where each trough width is no more than about 25 mm.

19. The method of continuously casting metal strip of claim 11 where the raised portion of each side dam is shaped to be capable of guiding flow of molten metal in a casting pool.

20. The method of continuously casting metal strip of claim 11 where the raised portion is arcuate.

* * * * *

UNITED STATES PATENT AND TRADEMARK OFFICE

CERTIFICATE OF CORRECTION

PATENT NO. : 8,191,610 B2
APPLICATION NO. : 12/624943
DATED : June 5, 2012
INVENTOR(S) : Rama Ballav Mahapatra and Brian E. Bowman It is certified that error appears in the above-identified patent and that said Letters Patent is hereby corrected as shown below:

IN THE DRAWINGS:

Sheet 1, Fig. 1, should read as follows: the reference numeral 43 should be applied to the upper collar portion adjacent to the thin cast strip 21 and the reference numeral 53 should be applied to the housing portion adjacent to the thin cast strip 21:

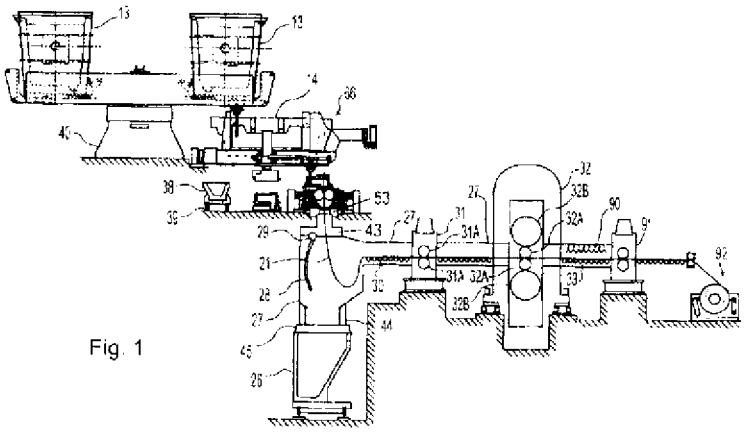

Fig. 1

Signed and Sealed this
Twenty-third Day of October, 2012

David J. Kappos
*Director of the United States Patent and Trademark Office*

Figure 3:
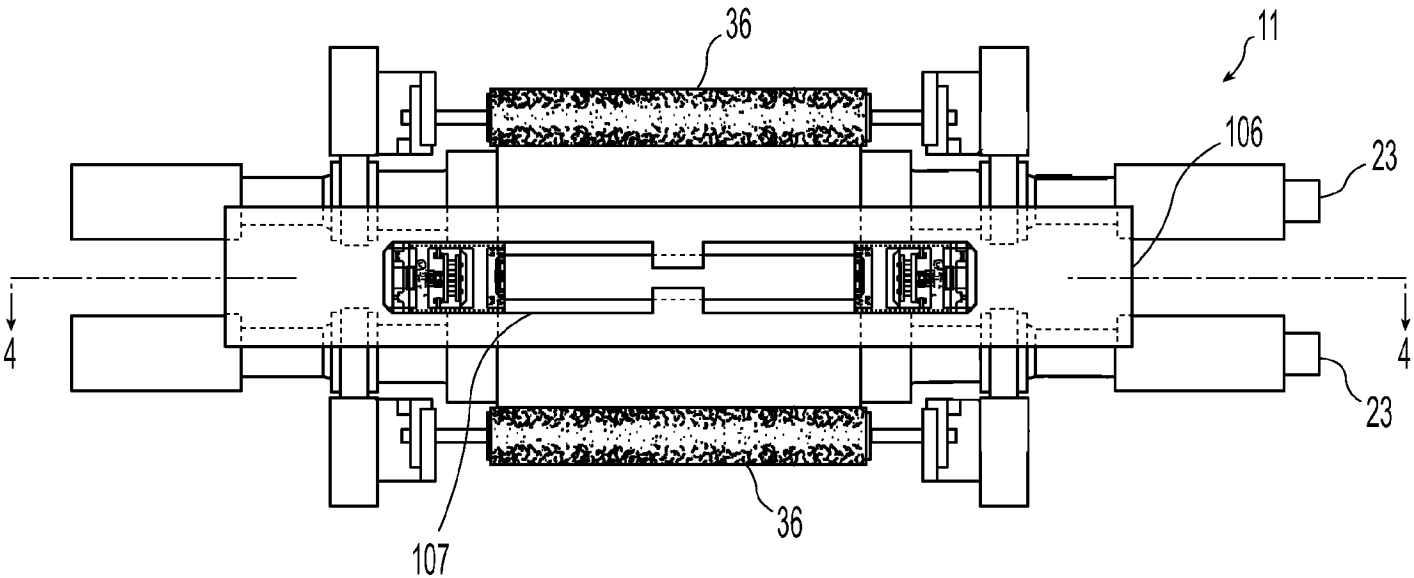
FIG. 3 is diagrammatical plan view of the roll cassette of FIG. 2 removed from the caster.

IN THE DRAWINGS:

Sheet 3, Fig. 3, the reference numerals 36, 106, and 107 should be deleted: